US007855332B1

(12) United States Patent
Turos

(10) Patent No.: US 7,855,332 B1
(45) Date of Patent: Dec. 21, 2010

(54) DRUMSTICK SYSTEM

(75) Inventor: Kenneth Turos, Las Cruces, NM (US)

(73) Assignee: Sun Systems, Inc., Las Cruces, NM (US)

( * ) Notice: Subject to any disclaimer, the term of this patent is extended or adjusted under 35 U.S.C. 154(b) by 0 days.

(21) Appl. No.: 12/422,654

(22) Filed: Apr. 13, 2009

Related U.S. Application Data

(63) Continuation-in-part of application No. 12/122,320, filed on May 16, 2008, now Pat. No. 7,538,264.

(51) Int. Cl.
*G10D 13/02* (2006.01)

(52) U.S. Cl. ..... 84/422.4

(58) Field of Classification Search ..... 84/422.4
See application file for complete search history.

(56) References Cited

U.S. PATENT DOCUMENTS

| | | | | |
|---|---|---|---|---|
| 3,165,964 | A * | 1/1965 | Stys et al. | 84/422.4 |
| 4,320,688 | A * | 3/1982 | Donohoe | 84/422.4 |
| 4,488,470 | A | 12/1984 | Larrain | |
| 4,570,527 | A | 2/1986 | Pruitt | |
| 4,763,557 | A | 8/1988 | Donohoe | |
| 5,170,001 | A | 12/1992 | Amedola | |
| 5,503,056 | A | 4/1996 | Evans | |
| 5,503,057 | A | 4/1996 | Smith, Jr. | |
| 6,028,260 | A | 2/2000 | LaLonde | |
| 6,028,261 | A | 2/2000 | Johnson | |
| 7,084,339 | B2 * | 8/2006 | Rundle | 84/422.4 |
| 2003/0176577 | A1 * | 9/2003 | Sano | 525/178 |
| 2004/0231493 | A1 * | 11/2004 | Milne et al. | 84/422.4 |
| 2006/0027073 | A1 * | 2/2006 | Richard | 84/422.4 |

* cited by examiner

*Primary Examiner*—Kimberly R Lockett
(74) *Attorney, Agent, or Firm*—Ray R. Regan

(57) ABSTRACT

The specification and drawing figures describe and show a drumstick system that includes a percussion member from which a tubular body extends. The percussion member includes a plug connectable to a drumhead contact tip is attached. One end of a hollow cylindrical tube having a sleeve or color coating is connected to the percussion member. The other end of the hollow cylindrical tube is attached to a neck. Metal spacers are mountable on the tubular body and neck. Mufflers are inserted into the tubular body and neck. A plurality of sleeves is provided for replaceably mounting on the drumstick system or on any drumstick made of any materials.

14 Claims, 4 Drawing Sheets

DRUMSTICK SYSTEM

CROSS-REFERENCE TO RELATED APPLICATION

This application is a continuation-in-part from a application Ser. No. 12/122,320 entitled an ERGONOMIC DURABLE DRUMSTICK filed on May 16, 2008 now U.S. Pat. No. 7,538,264 ("Parent Application") for which the U.S. Patent Office issued a notice of allowability on Mar. 8, 2009 to the same sole inventor named in this application. The specification of the application is incorporated by reference into this document.

FIELD OF TECHNOLOGY

The apparatus and method disclosed, illustrated and claimed in this document pertain generally to percussion instruments, specifically an apparatus for playing a drum. More particularly, the new and useful ergonomic durable drumstick of this document provides a drumstick that is durable, is efficiently held by a musician, and is visually distinctive and appealing by providing a range of color aesthetics.

BACKGROUND

Apparatus for percussively striking the head of a drum or other instruments (such as triangles, cymbals, and bells), commonly known as drumsticks, traditionally have been made of wood. More recently, some drumsticks have been fashioned of metal, plastics, and/or combinations of alternative materials. Little thought or design effort has been made in connection with improving the tympanic sound of a drumstick, its ergonomic handling, its durability, or visual aesthetics.

Wood, however, is not durable when shaped into a drumstick wielded by a musician intent on beating a drum as rapidly or as loudly as possible. Wood drumsticks break frequently during use. Efforts to make drumsticks from metal, plastics or other materials generally result in a drumstick that produces an unacceptable sound. Drumsticks made of material other than wood are often difficult to hold. While playing, a musician's fingers and palms may become sweaty, and drumsticks made of material other than wood slip from a musician's grip, or rotate unexpectedly. In the past, the different "feel" of drumsticks made of material other than wood has caused a musician to render music differently. And it is common knowledge that a wood drumstick, generally tan in color, is not an instrument that attracts attention or even interest among observers.

Accordingly, a need exists in the music industry for a new, useful, and improved ergonomic durable drumstick that is capable of indefinite use, rendering a pure sound, easily held during use, and is attractive not only to the musician, but to observers.

SUMMARY

The apparatus and method disclosed, illustrated and claimed in this document address the above-stated needs by providing a drumstick that includes a percussion member. A tubular body extends from one end of the percussion member. The tubular body is formed with a chamber. The percussion member includes a plug. The plug extends from the other end of the percussion member. A plurality of annular rings protrudes from the outer surface of the cylindrical plug. In addition, the plug includes a conical leading end. The conical leading end is designed to engage a drumhead contact tip. Accordingly, the drumhead contact tip is formed with a hollow bore into which the conical leading end may be inserted to fixedly engage the drumhead contact tip. In addition, a hollow cylindrical tube is provided. One end of the hollow cylindrical tube is connected to the tubular body. The other end of the hollow cylindrical tube is connected to a neck. A plurality of spacers is provided for engagement with the tubular body and with the neck. In addition, one or more mufflers are provided. The mufflers are insertable into opposing ends of the hollow cylindrical tube.

It will become apparent to one skilled in the art that the claimed subject matter as a whole, including the structure of the apparatus, and the cooperation of the elements of the apparatus, combine to result in a number of unexpected advantages and utilities. The structure and co-operation of structure of the ergonomic durable drumstick will become apparent to those skilled in the art when read in conjunction with the following description, drawing figures, and appended claims.

The foregoing has outlined broadly the more important features of the invention to better understand the detailed description that follows, and to better understand the contributions to the art. The ergonomic durable drumstick is not limited in application to the details of construction, and to the arrangements of the components, provided in the following description or drawing figures, but is capable of other embodiments, and of being practiced and carried out in various ways. The phraseology and terminology employed in this disclosure are for purpose of description, and therefore should not be regarded as limiting. As those skilled in the art will appreciate, the conception on which this disclosure is based readily may be used as a basis for designing other structures, methods, and systems. The claims, therefore, include equivalent constructions. Further, the abstract associated with this disclosure is intended neither to define the ergonomic durable drumstick, which is measured by the claims, nor intended to limit the scope of the claims. The novel features of the ergonomic durable drumstick are best understood from the accompanying drawing, considered in connection with the accompanying description of the drawing, in which similar reference characters refer to similar parts, and in which:

Figure 1:
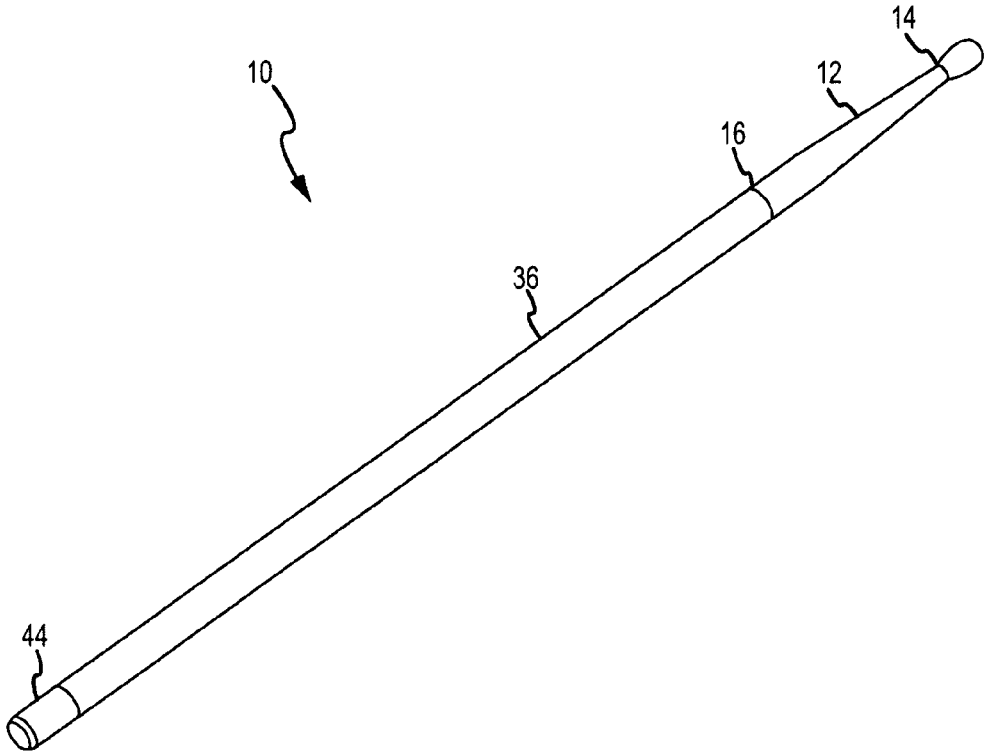
FIG. 1 of the drawing is a perspective view of the ergonomic durable drumstick following assembly of the component parts.

To the extent that the numerical designations in the drawing figures include lower case letters such as "a,b" such designations include multiple references, and the letter "n" in lower case such as "a-n" is intended to express a number of repetitions of the element designated by that numerical reference and subscripts.

DETAILED DESCRIPTION

Definitions

The term "sleeve dimpling" as used in this document means the tendency of the sleeve to rise above the exposed surface of hollow cylindrical tube, or ripple, when the components of the drumstick are fitted together by compression.

The term "first muffler" and "second muffler" mean a substantially solid cylindrical column made of rubber, foam, or similar materials that not only eliminate a tinny sound when the assembled drumstick strikes a drumhead, but also absorbs tympanic harmonics transmitted from the drumhead to the hands, wrists and muscles of the user of the drumstick.

The term "tympanic harmonics" means harmonics transmitted from the drumhead to the hands, wrists and muscles of the user of the drumstick in operation of the drumstick.

The term "color aesthetics" means that a wide range of colors and patinas that are possible by applying varying metal finishing treatments during manufacture, or due to applying sleeves having a wide assortment of colors.

As used in this document the term "exemplary" means serving as an example, instance, or illustration; any aspect described in this document as "exemplary" is not intended to mean preferred or advantageous over other aspects of the ergonomic durable drumstick.

DESCRIPTION

As illustrated in FIGS. 1-4, an ergonomic durable drumstick is provided that in its broadest context includes a percussion member. A tubular body extends from one end of the percussion member. The tubular body is formed with a chamber. The percussion member includes a plug. The plug extends from the other end of the percussion member. A plurality of annular rings protrudes from the outer surface of the cylindrical plug. In addition, the plug includes a conical leading end. The conical leading end is designed to engage a drumhead contact tip. Accordingly, the drumhead contact tip is formed with a hollow bore into which the conical leading end is insertable to fixedly engage the drumhead contact tip. In addition, a hollow cylindrical tube is provided. One end of the hollow cylindrical tube is connected to the tubular body. The other end of the hollow cylindrical tube is connected to a neck. A plurality of spacers is provided for engagement with the tubular body and with the neck. In addition, one or more mufflers are provided. The mufflers are insertable into opposing ends of the hollow cylindrical tube. In combination, the components of the ergonomic durable drumstick provide an exemplary means for playing a drum.

Figure 2:
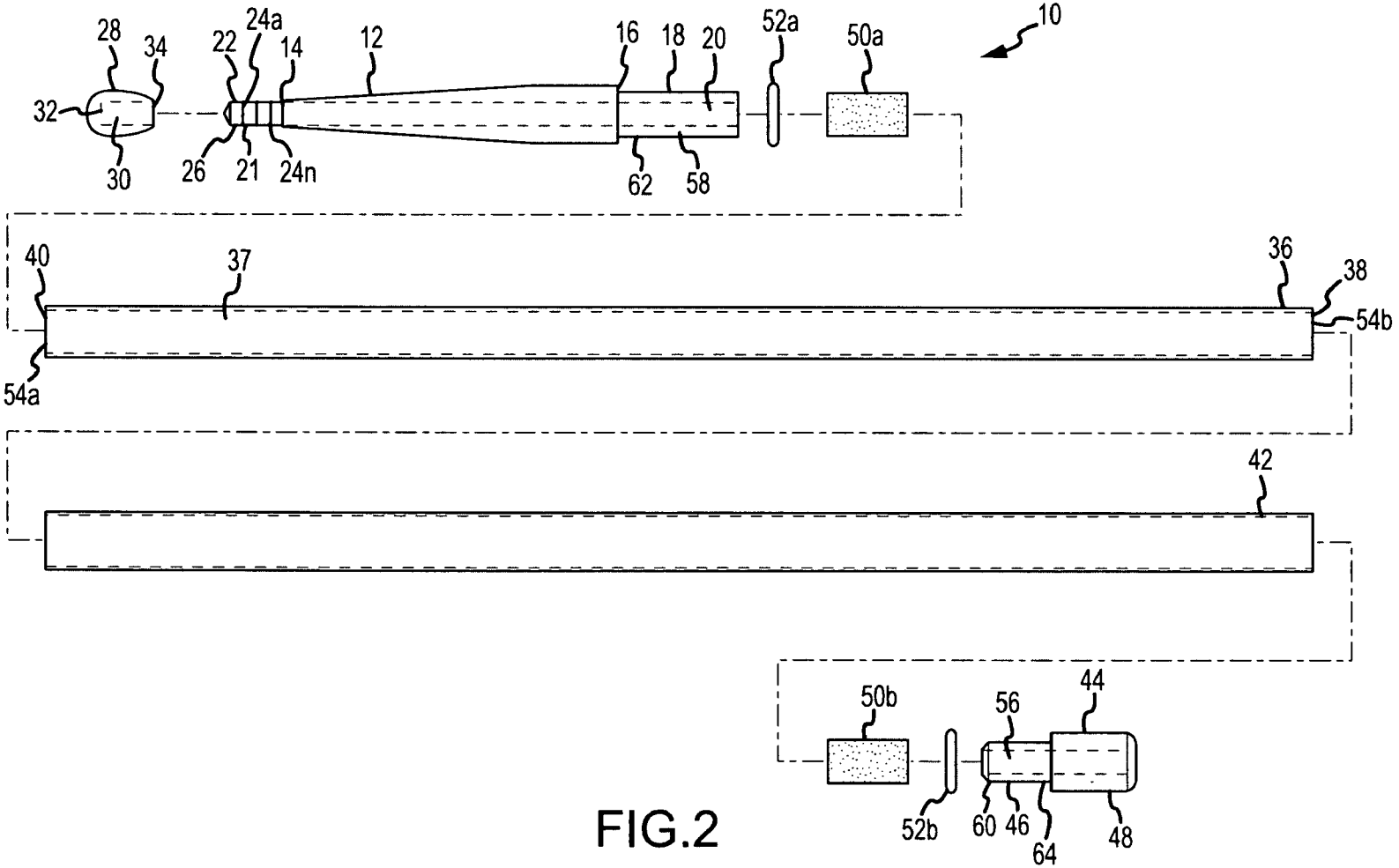
FIG. 2 is a side exploded view illustrating the ergonomic durable drumstick.

More specifically, an ergonomic durable drumstick 10 includes a tapered substantially hollow percussion member 12. The tapered substantially hollow percussion member 12 is formed with a distal end 14 and a proximal end 16. The tapered substantially hollow percussion member 12 also includes a tubular body 18. As illustrated in FIG. 2, the tubular body 18 is formed with a chamber 20. In one aspect of the ergonomic durable drumstick 10, the tubular body 18 extends monolithically from the proximal end 16 of the tapered substantially hollow percussion member 12. As illustrated in FIG. 2, the tubular body 18 has a circumference that is less than the circumference of the proximal end 16 of the tapered substantially hollow percussion member 12.

The ergonomic durable drumstick 10 also includes a plug 21. The plug 21 has a circular cross-section. The plug 21 is formed with conical leading end 22. In one aspect of the ergonomic durable drumstick 10, the conical leading end 22 monolithically extends from the distal end 14 of the tapered substantially hollow percussion member 12. As also illustrated in FIG. 2, the plug 21 includes a plurality of annular rings 24*a-n*. The plurality of annular rings 24*a-n* protrudes from the outer surface 26 of the plug 21 between the conical leading end 22 and the distal end 14 of the percussion member 12. In operation, the conical leading end 22 provides the mechanical advantage of fixedly engaging the percussion member 12 with a drumhead contact tip 28 that is also included in the ergonomic durable drumstick 10. Thus, as illustrated by cross reference between FIGS. 1 and 2, the drumhead contact tip 28 is formed with a hollow bore 30. The hollow bore 30 has a closed end 32 and an open end 34. The open end 34 is adapted to receive the plug 21. In addition, the closed end 32 of the drumhead contact tip 28 provides a surface into which the conical leading end 22 of the percussion member 12 may be driven by compression to ensure that the drumhead contact tip 28 is fixedly connected to the tapered substantially hollow percussion member 12.

The ergonomic durable drumstick 10 also includes a hollow cylindrical tube 36 best illustrated by cross-reference between FIGS. 1 and 2. The hollow cylindrical tube 36 has an aft end 38 and a fore end 40. As illustrated, the fore end 40 is fixedly connectable to the tubular body 18. In one aspect of the ergonometric durable drumstick 10, a sleeve 42 is surroundingly formed on and around the hollow cylindrical tube 36. In one aspect of the ergonomic durable drumstick 10, the sleeve 42 is formed from a polyolefin material. As a person skilled in the art will appreciate, a polyolefin material is a polymer produced from olefin, also called an alkene, as a monomer. In general, polyethylene is a polyolefin produced by polymerizing the olefin ethylene. Although polyolefin has proven advantageous in forming the sleeve on the hollow cylindrical tube, the use of polyolefin is not a limitation of the disclosure and claims of this document, and other materials may be used to achieve the mechanical and visual advantages and benefits of the ergonomic durable drumstick 10. The sleeve 42 surroundingly formed on the hollow cylindrical tube 36 provides at least two mechanical and aesthetic advantages. The sleeve provides a grippable surface for a musician to hold and manipulate the ergonomic durable drumstick 10. In addition, the sleeve 42 is provided in a wide range of colors and patinas, thus providing color aesthetics desired by musicians. In another aspect of the ergonometric durable drumstick 10, rather than a sleeve 42 the exterior visible surface 37 of the hollow cylindrical tube 36 may be powder coated with one or more colors to achieve the desirable aesthetic features recited in this document. In yet another aspect of the ergonometric durable drumstick 10 a sleeve 42 is provided from one or more materials selected from the group of materials consisting of metal, rubber, foam, nylon and plastic. The length of the hollow cylindrical tube 36 along the longitudinal axis of the hollow cylindrical tube 36 is substantially equal to the length of the sleeve 42 formed on the hollow cylindrical tube 36 so as to provide the mechanical advantage of avoiding unraveling of the sleeve following compressive assembly of the drumstick 10.

As also illustrated by cross-reference between FIGS. 1 and 2, a substantially hollow neck 44 is provided. The substantially hollow neck 44 includes a first member 46 that is attached to a second member 48. The circumference of the first member 46 is less than the circumference of the second member 48, providing the mechanical advantage described below in connection with the use of spacers.

In one aspect of the ergonometric durable drumstick 10, a plurality of mufflers 50*a,b* and a plurality of spacers 52*a,b* is provided. As illustrated best in FIG. 2, mufflers 50*a,b* are insertable into opposing ends 54*a,b* of the hollow cylindrical tube 36. Mufflers 50*a,b* achieve the mechanical advantage of dampening tympanic harmonics during use of an ergonometric durable drumstick 10. In another aspect (not shown), a portion of either muffler 50*a* is insertable into chamber 20 of tubular body 18, and/or muffler 50*b* is insertable into a hollow duct 56 of the first member 46 of the neck 44.

As indicated, a plurality of spacers 52*a,b* is provided. A first spacer 52*a*, as illustrated in FIG. 2, is slidably engageable with the exterior surface 58 of the tubular body 18. In addition, a second spacer 52*b* is slidably engageable on the outside surface 60 of the first member 46 of the hollow neck 44. The mechanical advantage of the use of the first spacer 52*a* and the second spacer 52*b* is to eliminate sleeve dimpling as described in this document when a sleeve 42 consisting of a material other than one or more powder coats is used. Thus, when the fore end 40 of the hollow cylindrical tube 36 is compressed against the first muffler 50*a* mounted on the tubular body 18, and is secured against the exposed face 62 of the proximal end 16 of the percussion member 12, sleeve dimpling in the area adjacent the fore end 40 of the hollow cylindrical tube 36 on which a sleeve 42 is surroundingly formed is eliminated. Likewise, when a second spacer 52*b* is slidably engaged with the first member 46 of the neck 44, and the aft end 54*b* of the hollow cylindrical tube 36 is compressed against the spacer 52*b* that is likewise adjacent the face 64 of the second member 48 of the neck 44, sleeve dimpling in the area adjacent the aft end 38 of the hollow cylindrical tube 36 is also eliminated.

As will be evident to a person of skill in the art, a variety of materials may be used to make and assemble the ergonomic durable drumstick 10. For example, in one aspect of the ergonomic durable drumstick 10, the drumhead contact tip 28 preferably is made of nylon. However, the use of nylon is not a limitation of the ergonomic durable drumstick 10. Nylon has proven satisfactory, however, in replicating the traditional and desired sound of a drum beaten by a drumstick having the drumhead contact tip 28. In addition, nylon is expandable. Accordingly, when the conical leading end 22 of plug 21 is inserted into the drumhead contact tip 28, the conical leading end 22 and the annular rings 24*a-n* create forces that contribute to fixedly holding drumhead contact tip 28 on ergonometric durable drumstick 10. Likewise the first muffler 50*a* and the second muffler 50*b* may be made of rubber, or, in the alternative, and in another aspect, may be made of foam. As evident, however, to a person skilled in the art, the use of rubber or foam is not limitations of the ergonomic durable drumstick 10.

While the apparatus disclosed and claimed in the Parent Application has proven useful for the intended uses and purposes described in that document, additional contributions to the art disclosed, illustrated and claimed in this document provide other optimizations and embodiments in which the principles of operation with different configurations result in additional features and uses for the drumstick system of this document.

At least one problem solved by the technical improvements disclosed in this document is enhancement of the center of gravity and center of mass balance for a user of the drumstick system. This feature is achieved by providing a hollow cavity having a blocked end in the hollow percussion member of the drumstick system. In combination, the two features of the hollow cavity having a blocked end contribute to an enhanced center of gravity and center of mass balance.

Greater center of gravity and center of mass balance also is achieved by providing a solid neck as part of the second member which in one aspect may be solid, and in an alternative aspect may be hollow, insertable into at least one of the opposing ends of the hollow cylindrical tube held during use of the drumstick system.

Another feature included in the drumstick system of this document consists of making available one or more additional sleeves. Use of the sleeve described in this document has proven useful to drummers for maintaining a grip on a drum stick, regardless of the material used to make the drumstick. A sleeve, however, may become damaged during use. Providing one or more additional sleeves for the drumstick system, and providing a plurality of sleeves for use by users of a drumstick other than the drumstick of the drumstick system, allows a drummer to attach and remove a damaged sleeve, and to replace the damaged sleeve with a new sleeve. The material used to make the plurality of sleeves allows a user to insert the sleeve over a drumstick, and, using heat shrinking techniques described in this document, attach the sleeve to a drumstick made of any material. The sleeve has proven useful on drumsticks made of a variety of materials including traditional wood drumsticks. Accordingly, one or more sleeves may be provided separately to allow a drummer to apply a sleeve to any drumstick made of any material.

In addition, both the method of making the drumstick system, and the system's rigidity and durability, are enhanced for certain uses by assembling the drumstick system with metal spacers, preferably made of aluminum. Likewise, in an alternative aspect, means for connecting selected components of the drumstick system may be by use of interconnectable threaded connecting means rather than compressibly connecting the components. For one non-exclusive example, the drumhead contact tip and the plug may be formed so as to be interconnectable by threaded connecting means.

More specifically, as shown by cross reference between FIGS. 1-4, in a drum stick system 100 an enhanced center of gravity and center of mass balance may be achieved by providing a hollow cavity 102 having a blocked end 104 in the percussion member 12 of the drumstick system 100. In combination, the two features of the hollow cavity 102 having a blocked end 104 contribute to an enhanced center of gravity and center of mass balance.

Figure 3:
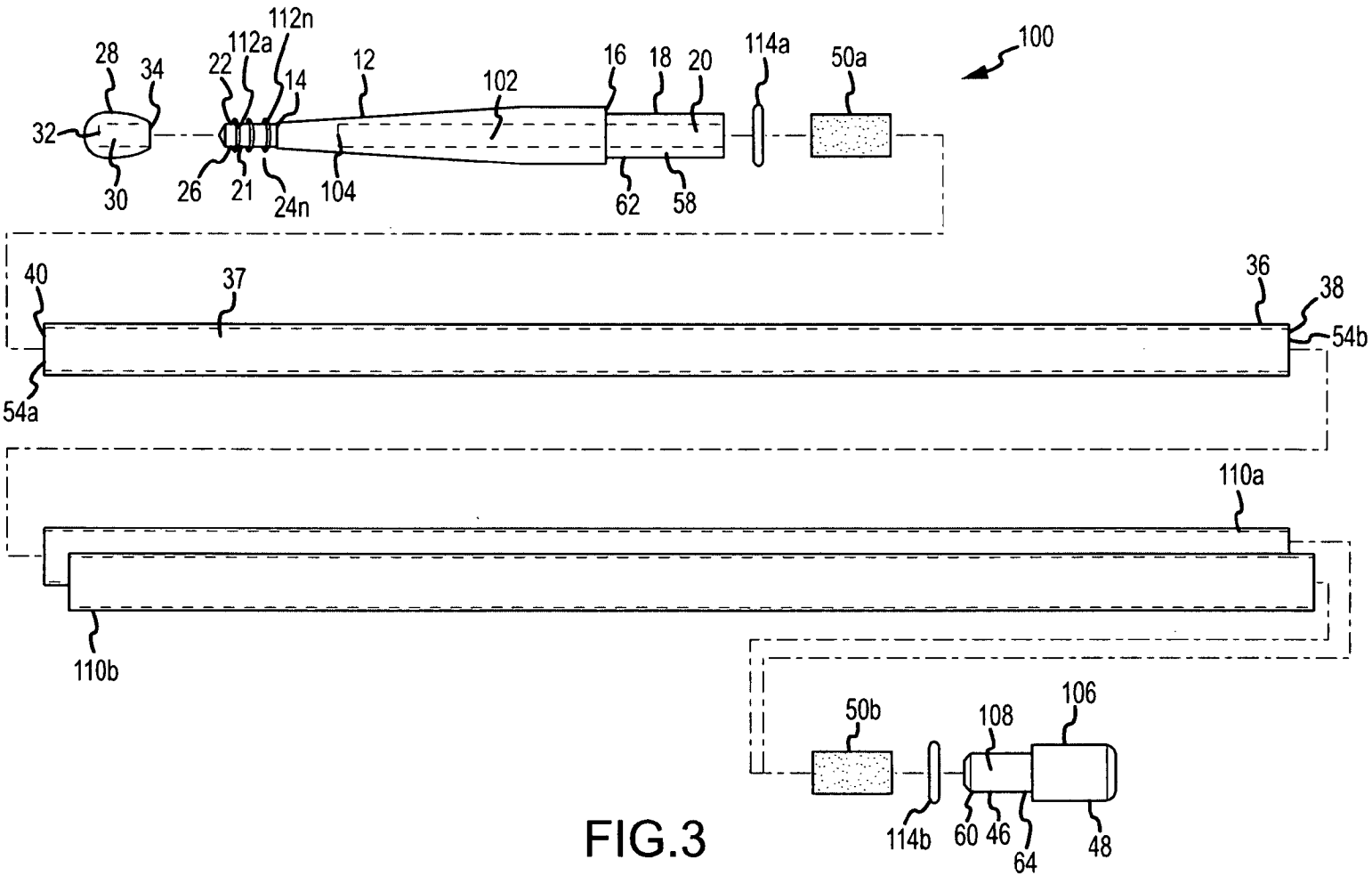
FIG. 3 is a side exploded view illustrating additional aspects of the ergonomic durable drumstick of the drumstick system of this document.

As illustrated in FIG. 3, greater center of gravity and center of mass balance also is achieved by providing a solid neck 106 as an alternative to the hollow neck 44 that is illustrated in FIG. 2. The solid neck 106 is an extension of member 108 which, as shown, also may be solid in one aspect, or hollow as shown in FIG. 2 as having hollow duct 56.

Another feature included in the drumstick system 100 of this document consists of making available one or more additional sleeves 110*a,b* as illustrated in FIG. 3. Use of the sleeve 110 described in this document has proven useful to drummers for maintaining a grip on the drum stick system 100. A sleeve 110 originally provided with the drum stick system 100 may, however, become damaged during use, or may wear. Providing one or more additional sleeves 110*a,b* allows a user of the drum stick system 100 to remove a damaged sleeve 110*a* and replace the damaged sleeve with a new sleeve 110*b*, as illustrated in FIG. 3. The material used in making the sleeves 110*a,b* allows a user to insert a sleeve 110*b* over the hollow cylindrical tube 36 and attach sleeve 110*b* to hollow cylindrical tube 36 using heat shrinking techniques described in this document. The sleeve 110 also has proven useful on drum sticks made of a variety of materials including traditional wood drum sticks. Accordingly, the one or more sleeves 110*a,b* may be provided separately from drum stick system 100 to enable a user of any drum stick made of any material to achieve the benefits of having sleeve 110 mounted on a drum stick. As a person of skill in the art will appreciate, the one or more sleeves 110*a,b* may also be made of polyolefin, neoprene, PVC, one or more polymers, plastic, rubber, or combinations of such materials.

In another aspect, an alternative to the annular rings 24*a-n* shown in FIG. 2 is provided consisting of a plurality of ribs 112*a-n* as illustrated in FIG. 3. The plurality of ribs 112*a-n* protrudes from the outer surface 26 of the plug 21 between the conical leading end 22 and the distal end 14 of the percussion member 12. In operation, the conical leading end 22 provides the mechanical advantage of fixedly engaging the percussion member 12 with a drumhead contact tip 28 that is also included in the drumstick system 100 by compressively inserting the plug 22 into the hollow bore 30 of drumhead contact tip 28 as indicated by cross-reference between FIGS. 2-4. Thus, as illustrated by cross-reference between FIGS. 1-4, the drumhead contact tip 28 is formed with a hollow bore 30. The hollow bore 30 has a closed end 32 and an open end 34. The open end 34 is adapted to receive the plug 21. In addition, the closed end 32 of the drumhead contact tip 28 provides a surface into which the conical leading end 22 of the percussion member 12 may be driven by compression to fixedly connect the drumhead contact tip 28 to the tapered substantially hollow percussion member 12 and held fixedly attached by the plurality of ribs 112*a-n* that lodge themselves within the drumhead contact tip 28.

Figure 4:
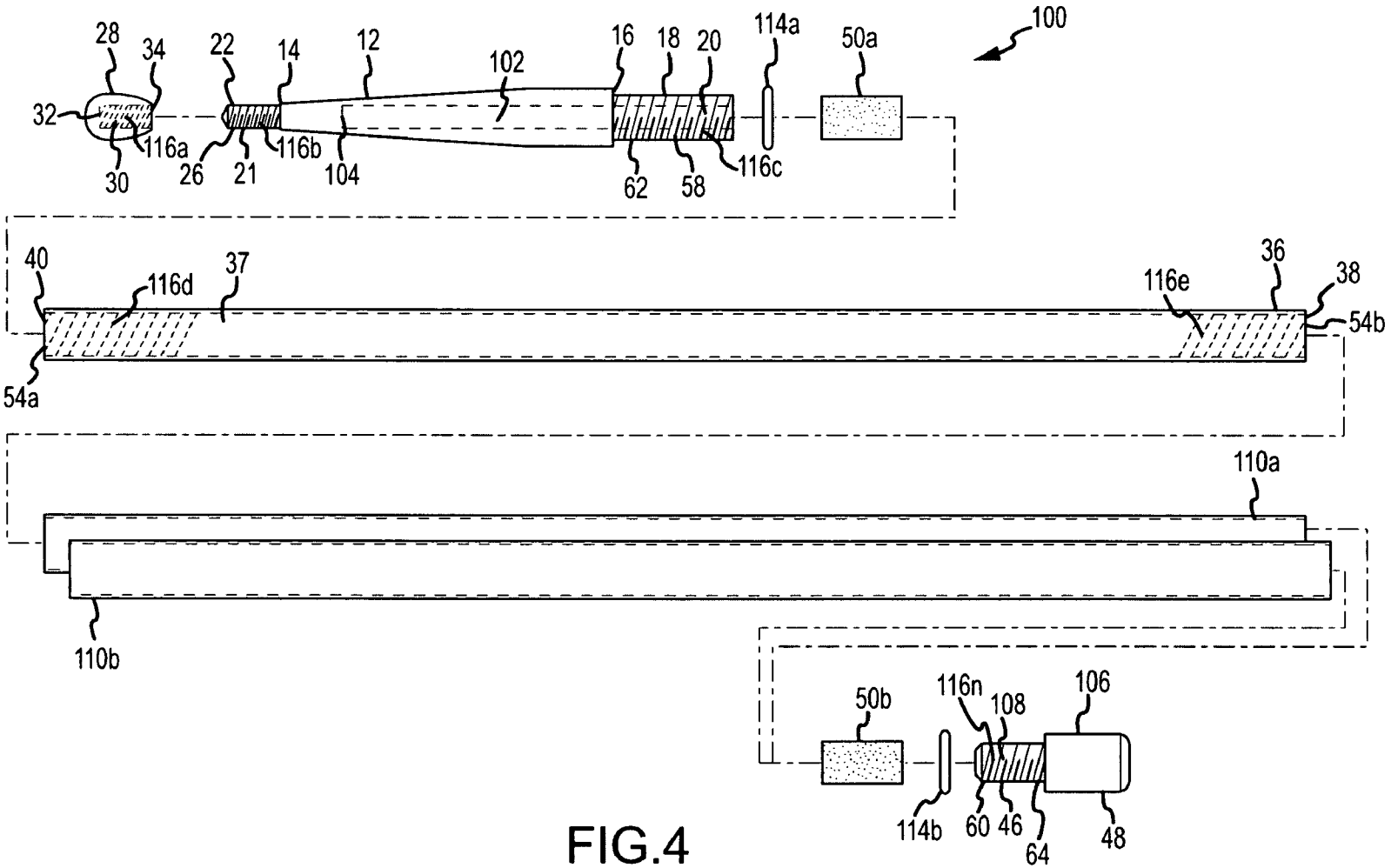
FIG. 4 is a side exploded view illustrating additional aspects of the ergonomic durable drumstick of the drumstick system of this document showing at least alternative connecting means for various components of the drumstick system.

In yet another aspect, threaded means 116*a-n* are provided to interconnect two or more components of the drumstick system 100, including those components illustrated as threaded portions 116*a-n* in FIG. 4. The threaded portions 116*a-n* provide the mechanical advantage, as shown in FIG. 4, of fixedly engaging the percussion member 12 with a drumhead contact tip 28 by threadable engagement. Thus, as illustrated by cross-reference between FIGS. 1-4, the drumhead contact tip 28 is formed with a hollow bore 30. The hollow bore 30 has a closed end 32 and an open end 34. The hollow bore 30 may be formed with threaded portion 116*a* that is mateably engageable with threaded portion 116*b* of plug 21 and held fixedly attached after threaded portion 116*a* is mated with threaded portion 116*b*.

Likewise, as further illustrated in FIG. 4, other components of the drumstick system 100 may be connected by threadable means. Thus, tubular body 18 may be formed with a threaded portion 116*c* that is mateably engageable with threaded portion 116*d* adjacent fore end 40 of hollow cylindrical tube 36. As also illustrated in FIG. 4, aft end 38 of hollow cylindrical tube 36 may be formed with a threaded portion 116*e* that is mateable engageable with threaded portion 116*n* of either first member 46 or solid member 108 of neck, as illustrated respectively by cross-reference between FIGS. 2-4.

In addition, as illustrated by cross-reference between FIGS. 3-4, both the method of making the drumstick system 100, and a drumstick's rigidity and durability, may be enhanced by assembling the drumstick system 100 with metal spacers 114*a,b*, preferably made of aluminum. An occasional problem encountered with the use of non-metallic spacers 52*a,b*, as illustrated in FIG. 2, is that forces exerted on non-metallic spacers 52*a,b* during use may cause deformation of non-metallic spacers 52*a,b*. In some climates, non-metallic spacers 52*a,b* may dry out too quickly. The use of a plurality of metal spacers 114*a,b* addresses those problems.

As illustrated in FIGS. 3 and 4, mufflers 50*a,b* are insertable into opposing ends 54*a,b* of the hollow cylindrical tube 36. Mufflers 50*a,b* achieve the mechanical advantage of dampening tympanic harmonics during use of an ergonometric durable drumstick 10. In another aspect (not shown), a portion of either muffler 50*a* is insertable into chamber 20 of tubular body 18, and/or muffler 50*b* is insertable into a hollow duct 56 of the first member 46 of the neck 44. A first metal spacer 114*a*, as illustrated in FIG. 3, is slidably engageable with the exterior surface 58 of the tubular body 18. In addition, a second metal spacer 114*b* is slidably engageable on the outside surface 60 of the first member 46 of the hollow neck 44. A mechanical advantage of the use of the first metal spacer 114*a* and the second metal spacer 114*b* is to eliminate sleeve dimpling as described in this document when a sleeve 42 consisting of a material other than one or more powder coats is used.

Thus, when the fore end 40 of the hollow cylindrical tube 36 is attached against the first muffler 50*a* mounted on the tubular body 18, and is secured against the exposed face 62 of the proximal end 16 of the percussion member 12 by any connecting means, sleeve dimpling in the area adjacent the fore end 40 of the hollow cylindrical tube 36 on which a sleeve 42 is surroundingly formed is eliminated.

Likewise, when a second metal spacer 114*b* is slidably engaged with the first member 46 of the neck 106, and the aft end 54*b* of the hollow cylindrical tube 36 is attached against the metal spacer 114*b* that is likewise adjacent the face 64 of the second member 48 of the neck 106, sleeve dimpling in the area adjacent the aft end 38 of the hollow cylindrical tube 36 is also eliminated.

Claim elements and steps in this document have been numbered solely as an aid in understanding the description. The numbering is not intended to, and should not be considered as intending to, indicate the ordering of elements and steps in the claims. In addition, the ergonomic durable drumstick 10 illustrated in drawing FIGS. 1 through 2 shows at least one aspect of the ergonomic durable drumstick that is not intended to be exclusive, but merely illustrative of the disclosed embodiment. As a person skilled in the art will appreciate, method steps may be interchanged sequentially without departing from the scope of the ergonomic durable drumstick. In addition, means-plus-function clauses in the claims are intended to cover the structures described as performing the recited function that includes not only structural equivalents, but also equivalent structures. Likewise, although the apparatus and methods provide for use with currently known materials and technologies, the materials and technologies are not limitations of future uses or methods of making the ergonomic durable drumstick; rather, it is expected that such materials and technologies will change over time.

What is claimed is:

1. An apparatus for playing a drum, comprising:

a tapered percussion member to which a partially hollow tubular body monolithically extends from one opposing end;

a plug extending from the other opposing end of the tapered percussion member, wherein the plug is formed with means for connecting the plug and a drumhead contact tip;

means connectable to the apparatus for holding the assembled drumstick;

a plurality of sleeves replaceably and slidably engageable with the means for holding the drumstick;

a solid neck attachable to the means for holding the drumstick; and one or more metal spacers and one or more mufflers engageable with the apparatus.

2. An apparatus for playing a drum as recited in claim 1, wherein the means for connecting the plug and the drumhead contact tip includes a plurality of ribs for fixedly engaging the plug and the drumhead contact tip by compression.

3. An apparatus for playing a drum as recited in claim 1, wherein the means for connecting the plug and the drumhead contact tip includes threadable means for connecting the plug and the drumhead contact tip.

4. An apparatus for playing a drum as recited in claim 1, wherein the plurality of sleeves is formed of a material substantially surroundingly mountable on the means for holding the drumstick.

5. An apparatus for playing a drum as recited in claim 4, wherein the plurality of sleeves is formed of a polyolefin material heat shrinkable onto an exposed surface of the means for holding the drumstick.

6. An apparatus for playing a drum as recited in claim 4, wherein the plurality of sleeves is formed of neoprene, PVC, one or more polymers, plastic, and/or rubber.

7. An apparatus for playing a drum as recited in claim 1, wherein the opposing ends of the means for holding the drumstick are formed with threaded portions threadably engageable with a mateable threaded portion of the partially hollow tubular body and with a mateable threaded portion of a neck.

8. An apparatus for playing a drum as recited in claim 1, wherein the drumhead contact tip is made of nylon, neoprene, PVC, one or more polymers, plastic, rubber, and/or combinations of such materials.

9. A method of making a drumstick, comprising:

selecting a plurality of materials for forming components of the drumstick selected from the group of materials consisting of metal, rubber, foam, nylon and plastic;

manipulating the metal material to form a percussion member having a tapered partially hollow cylindrical body;

forming at one end of the percussion member a substantially hollow tubular metal body;

connecting to the opposing end of the percussion member a plug;

attaching to the plug a material for forming a contact tip for contact with a drumhead;

forming a hollow metal cylindrical tube having one opposing one end connectable to the tubular metal body formed with a chamber, and further wherein a plurality of sleeves slidably and replaceably engageable with the exterior surface of the metal cylindrical tube by the application of heat;

connecting to the other opposing end of the hollow metal cylindrical tube a solid neck; and providing a plurality of metal spacers engageable with the exterior surface of the tubular metal body and outside surface of the solid neck.

10. A method of making a drumstick as recited in claim 9, further comprising one or more ribs mounted on the plug for compressible connection with the contact tip.

11. A method of making a drumstick as recited in claim 9, wherein the plurality of sleeves is formed of a material substantially surroundingly mountable on the drumstick.

12. A method of making a drumstick as recited in claim 11, wherein the plurality of sleeves is formed of a polyolefin material heat shrinkable onto an exposed surface of the drumstick.

13. A method of making a drumstick as recited in claim 12, wherein the plurality of sleeves is formed of neoprene, PVC, one or more polymers, plastic, or rubber.

14. A method of making a drumstick as recited in claim 9, further comprising making a first muffler and a second muffler insertable into opposing ends of the hollow metal cylindrical tube.

* * * * *